US005151070A

United States Patent [19]

Norman

[11] Patent Number: 5,151,070

[45] Date of Patent: Sep. 29, 1992

[54] RESISTANCE TRAINING DEVICE

[76] Inventor: Peter G. Norman, 35 Cambridge Park Court, Twickenham, Middlesex TW1 2JN, England

[21] Appl. No.: 742,203

[22] Filed: Aug. 5, 1991

Related U.S. Application Data

[63] Continuation of Ser. No. 399,465, filed as PCT/GB88/00104, Feb. 18, 1988, abandoned.

[30] Foreign Application Priority Data

Feb. 19, 1987 [GB] United Kingdom ..... 8703833
Mar. 17, 1987 [GB] United Kingdom ..... 8706302

[51] Int. Cl.[5] ..... A63B 21/00

[52] U.S. Cl. ..... 482/99; 482/101; 273/191 B

[58] Field of Search ..... 272/125, 130, 136, 142, 272/717, 118, 100, 116, 133, 143; 273/55 R, 191 R; 128/25 R

[56] References Cited

U.S. PATENT DOCUMENTS 3,489,416 1/1970 Mark ..... 273/191 A
3,703,294 11/1972 Fitch ..... 272/142
4,149,713 3/1979 Mcleod ..... 272/117
4,531,727 7/1985 Pitro ..... 272/143

FOREIGN PATENT DOCUMENTS 51407 7/1974 Australia .
58943 3/1984 Australia .
1291165 2/1987 United Kingdom ..... 272/130

*Primary Examiner*—Richard J. Apley
*Assistant Examiner*—Jerome Donnelly
*Attorney, Agent, or Firm*—Rosen, Dainow & Jacobs

[57] ABSTRACT

A resistance training device which includes a boom which may be connected at a variety of positions to a frame. The boom is provided with a curvilinear track in which a runner attached to handle is disposed. The runner is connected to a set of weights via a cable and pulley arrangement. In use, the handle and associated assembly is moved down the track against the resistance of the weights. The shape of the track is arranged to simulate the action of a limb during a sporting movement, for example the movement of the user's arm when taking golf swing, so that the apparatus exercises the user's muscles in precisely the way that is required for maximum benefit for the sporting action which corresponds to the shape of the track.

15 Claims, 2 Drawing Sheets

RESISTANCE TRAINING DEVICE

This application is a continuation, of application Ser. No. 07/399,465, filed as PCT/GB88/00104, Feb. 18, 1988, now abandoned.

This invention relates to a resistance training device.

Resistance training is the term used to describe a method of exercising muscles or parts of the body by movement against a resistive force, often provided by weights, springs or elastic material. Movement may be made either direclty against gravity, while the person positions himself according to a particular part of the body to be exercised, or equipment may be designed to allow the person to move a limb, or his body, against a variable resistance.

With conventional equipment using this type of training for sports requiring hand/eye co-ordination (e.g. golf and tennis)—which utilize a complicated movement involving different groups of muscles—much effort is wasted on exercising whole areas of the body unnecessarily.

Known resistance training devices often comprise a handle attached to weights by a cable which passes over a pulley. A user would normally pull the handle in a straight line directly towards himself. There is a wide variation in the line along which the handle travels, often even with repeated operation by the same user. This can detract from the effectiveness of the exercise and, in extreme cases a risk of injury can arise. In any event the exercise suffers reduced specificity to the muscles exercised.

According to the invention in a first aspect there is provided a resistance training device comprising a track defining a predetermined path, means coupled to the track and movable by action of a user along the path against the action of a resistive force.

According to the invention in a second aspect, there is provided a resistance training device comprising a track defining a predetermined path, operating means coupled to the track and resistance means coupled to the operating means, wherein the operating means is movable by action of a user along the path defined by the track against a resistance provided by the resistance means.

According to the invention in a third aspect there is provided a method of resistance training comprising the steps of; constraining a part of the body to move along a predetermined non-linear path, providing a resistive force to resist movement of the said part of the body along said path.

The described embodiment of the apparatus and method according to the invention allow a user to develop a muscle or a group of muscles to suit a particular movement associated with a given sport, according to the profile of the predetermined path through which the user is constrained to move the part of the body which is being exercised. Such predetermined path can simulate, for example, the path of a person's hand when taking a golf swing or when playing a stroke at tennis. Also, the invention is applicable to providing remedial treatment to compensate for excessive training and development of a group of muscles at a particular sport, which can cause strain. The described embodiment is also particularly applicable for warming-up players before a sport is played.

An embodiment of the invention will now be described, by way of example, with reference to the accompanying drawing in which.

Figure 1:
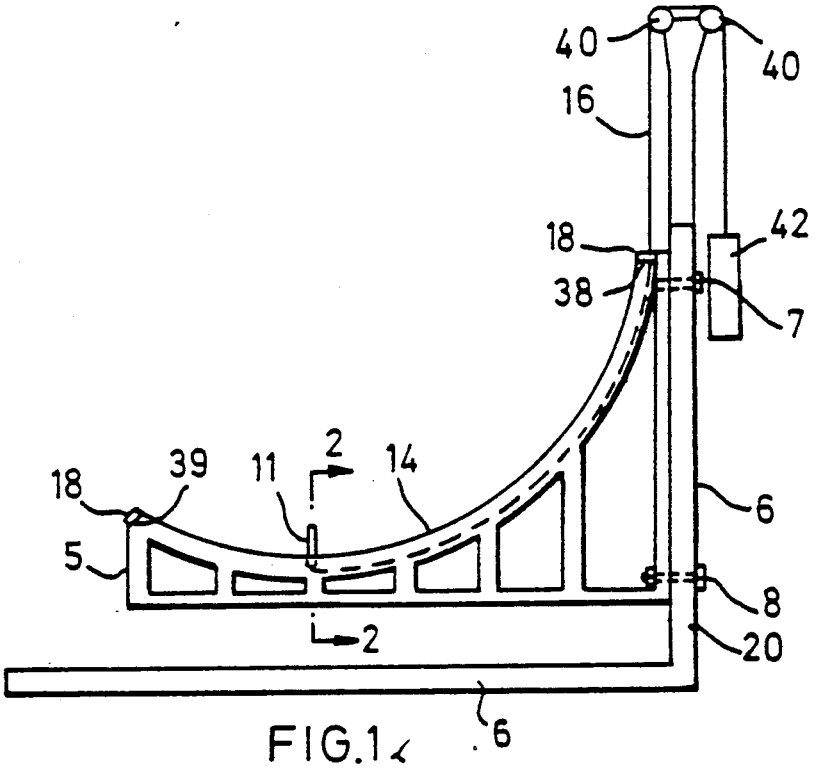
FIG. 1 is a front view of an embodiment of the invention.
Figure 2:
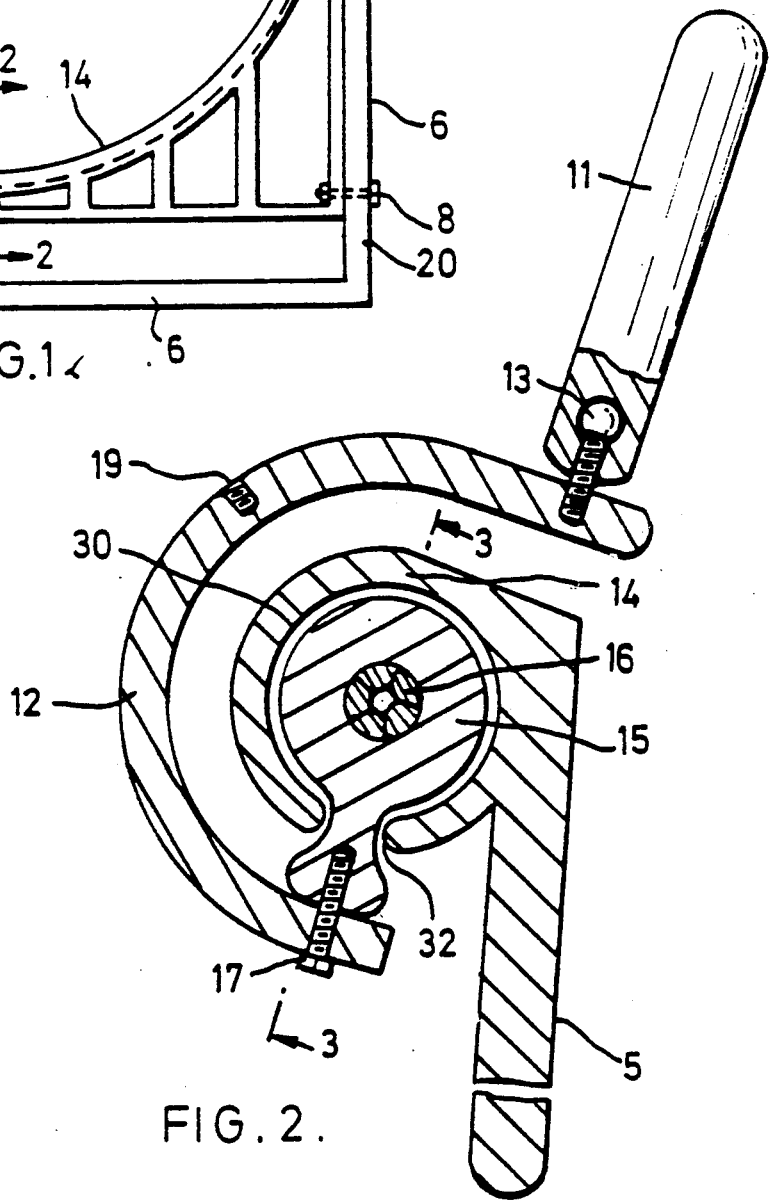
FIG. 2 is a partial sectional view taken in the plane 2—2 of FIG. 1.

With reference to FIG. 1, the embodiment of the invention includes a boom 5 connected to a frame 6 by bolts 7 and 8.

Figure 4:
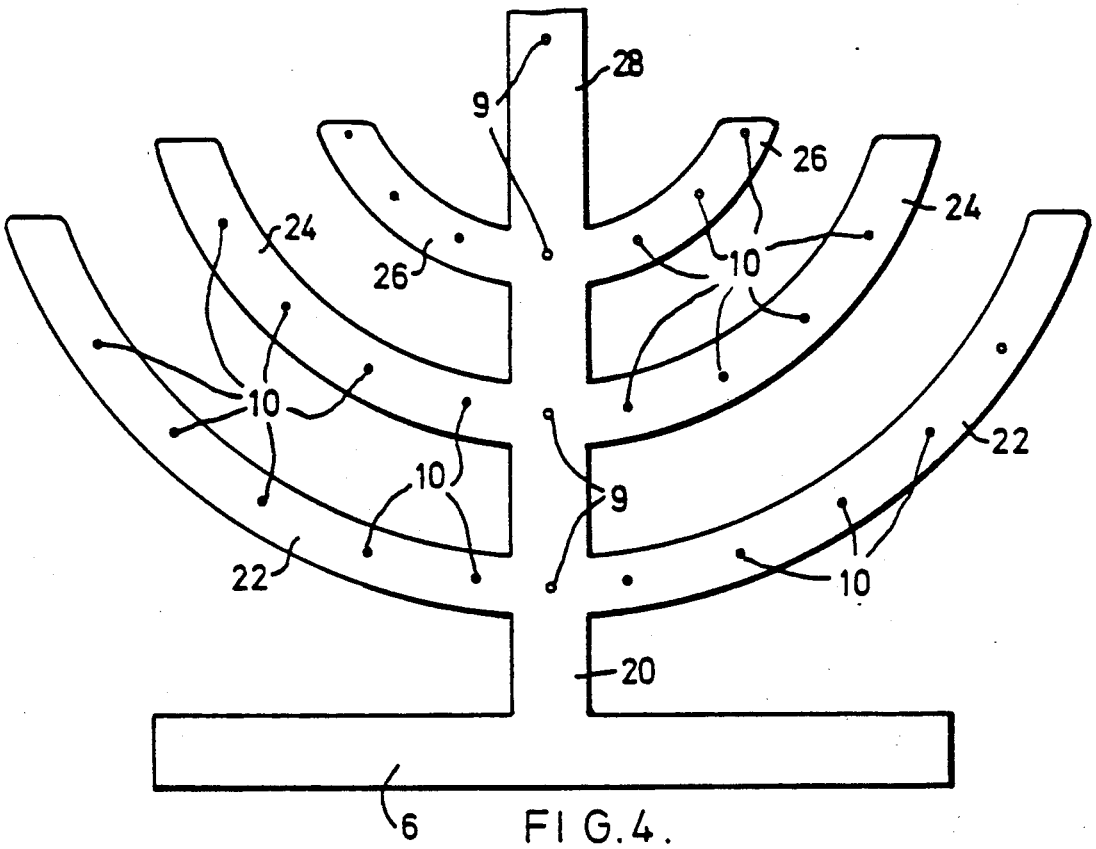
FIG. 4 is an end view of the frame shown in FIG. 1.

The frame 6 may be secured to a wall, for example, or may rest upon the ground. As shown in more detail in FIG. 4, the frame 6 is provided with a plurality of pairs of laterally extending arcuate arms 22, 24, 26, which project from a generally elongate portion 28. In use, the boom 5 may be attached at a selected height and angular position relative to the frame 6. This is achieved by locating a bolt 7 in any one of corresponding holes 9 provided in the elongate portion 28 and by locating a bolt 8 in any one of holes 10, so as to fix the boom at a desired position. The bolts 7 and 8 are retained in elongate slots in the frame 6 to allow adjustment of the position of the bolts to suit the different distances between holes 9 and 10 in the frame 6.

The boom 5 is provided with a curvilinear track 14 which defines a path of a shape which simulates the passage of a part of the (body in this case the hand of a golfer) during a sporting movement (in this case the swinging of a golf club). The track 14 is formed as a channel or socket 30 provided with an opening 32 which extends along the length of the channel 30. A first bearing member, for example a runner 15, is disposed within the channel 30, for slidable movement along the channel. (The channel 30 may be considered as a second bearing member). The runner 15 is connected at an underneath portion of the track 14 to a connecting member 12 by means of bolt 17. The member 12 extends to provide a support for an upwardly extending handle 11 which is detachably connected to the connecting member 12. Handle 11 may be connected so as to be offset relative to the longitudinal plane of the track by a slight angle either to the right, so that the handle 11 may be grasped by a right handed person (as shown), or the left, by attachment at threaded aperture 19. The handle 11 is connected to the connecting member 12 via a ball and socket joint 13 which allows rotation of the handle 11 about its longitudinal axis.

Figure 3:
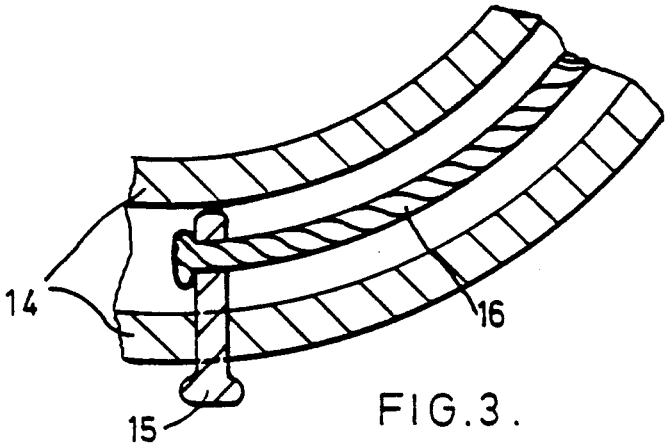
FIG. 3 is a partial sectional view taken in the plane 3—3 of FIG. 2.

The runner 15 is connected to a cable 16 (FIG. 3) and drawn over a pulley mechanism 40 attached to weights 42 at its distal end. Alternatively, the cable 16 may be connected at its distal end to one or more springs or other resilient means. The cable 16 is retained or constrained within the channel 30 or constraining means and thus does not interfere with the user's operation of the device.

The runner 15 is prevented from escaping from the channel 30 by means of stops 18 provided at each end of the track. These are preferably formed from resilient material, or are sprung, so that if the handle 11 and associated assembly are accidentally allowed to hit either of the stops 18 with excessive force, damage to the apparatus (and the user) is prevented.

In use, a user grasps the handle 11 and pulls the handle and associated assembly down the track from one end 38 to the other end 39, thus allowing the operator to simulate the desired sporting movement.

The track 14 may be made interchangable so that alternative tracks may be employed. For example, as shown in FIG. 1, the track illustrated is suitable for limiting the movements made by a golfer when swinging a golf club. Equally, the track may have a shape to allow simulation of the movement of the arm of a tennis player when playing a ground shot or serving.

The embodiment described above is not to be construed as limitative and other variations and modifications of the invention are envisaged within the scope of the invention. For example, the apparatus shown as being particularly designed for arm-eye co-ordination. With suitable modification it is equally applicable where leg-eye co-ordination is required, for example in association football in which a suitable track could be employed for simulating the movement of a leg when kicking a football. Also, in the embodiment described a handle has been shown connected to a slider which follows the track, the slider being connected, for example, to a set of the weights. However, other forms of device which would provide resistance to movement along the track could be employed. For example, the track could be arranged to be filled with a viscous liquid and the handle connected, via a seal, to a piston or other member. Resistance to movement of the handle and piston combination by the liquid would provide the required resistive force.

Also, while the device has been described for the specific use of resistance training, to strengthen and exercise a particular set of muscles, it may also be employed, with a suitable selection of track profile, for use by professional sportsmen for remedial action (constant training at a particulaar sport involving specialized muscular activities can cause development of groups of muscles resulting in strain on the back or other parts of the body and resistance training on other groups of muscles can compensate for this). Also, the device could be used as a warm-up device by players before a sport is played.

While the embodiment described includes a boom held by a frame, the boom could be secured directly to a suitable surface such as a wall, and the frame dispensed with.

I claim:

1. A resistance training device comprising a track defining a predetermined at least partially non-linear path and which path defines a plane, operating means coupled to the track, and resistance means for providing a resistance force coupled to the operating means, wherein the operating means is movable by action of a user along the path defined by the track against the resistance force provided by the resistance means, said operating means comprising a first bearing member and a handle, said handle connected to said first bearing member, said track comprising a second bearing member, said second bearing member comprising an elongate channel, the first bearing member comprising a runner coupled for movement relative to said second bearing member and coupling means comprising a flexible elongate member having a body part having a longitudinal axis and first and second ends, said body part comprising a first portion including said first end and a second portion including said second end, said first end connected to said runner and said second end connected to said resistance means, said first portion defined as that portion of the body part that is within said channel, said first portion being of variable length depending upon what length of said body part is within said channel at any given time, and said second portion being the remainder of said body part, said first portion of said body part being enclosed at all times within said channel and axially following the same path as said track, said first portion being disposed within said plane.

2. A device as claimed in claim 1, wherein the track defines a curvilinear path.

3. A device as claimed in claim 1 or claim 2, further comprising a frame to which the track is connected.

4. A device as claimed in claim 3, wherein the position of connection of the track to the frame is adjustable.

5. A device as claimed in claim 1 or claim 2, wherein the resistance force may be varied.

6. A device as claimed in claim 1 or claim 2, wherein said handle is pivotally mounted.

7. A device as claimed in claim 1 or claim 2, wherein said handle is connectable at alternative first and second positions relative to the first bearing member said positions being selected such that the device is manually operable by a left or right handed user respectively.

8. A device as claimed in claim 1 or claim 2, wherein said resistance means comprises at least one weight arranged to be raised above the ground when said operating means is moved along the track in a first direction.

9. A device as claimed in claim 1, wherein said resistance means comprises a resilient member connected to the operating means.

10. A device as claimed in claim 1 or claim 2, wherein said resistance means comprises a liquid for providing said resistance in response to movement of a part of said operating means through the liquid.

11. A resistance training device comprising a coupling means, constraining means, said coupling means connected to said constraining means, said constraining means, comprising a channel means which defines a predetermined at least partially non-linear path along which said coupling means moves and which path defines a plane, operating means coupled to the channel means, and resistance means for providing a resistance force coupled to the operating means wherein the operating means is movable by action of a user along the path defined by the channel means against the resistance force provided by the resistance means, and coupling means for coupling said resistance means to the operating means, said coupling means comprising a flexible elongate member having a body part having a longitudinal axis and first and second ends, said body part comprising a first portion including said first end and a second portion including said second end, said first end connected to said operating means and said second end connected to said resistance means, said first portion defined as that portion of the body part that is within said channel means, said first portion being of variable length depending upon what length of said body part is within said channel means at any given time, and said second portion being the remainder of said body part, said first portion of said body part being enclosed within said channel means and axially following the same path as said channel means and said first portion being disposed within said plane.

12. A device as claimed in claim 11, wherein said channel means has an open end and wherein a first portion of said coupling means is situated between said operating means and said channel means open end track.

13. A resistance training device comprising a track defining a predetermined curvilinear path, operating means coupled to the track, and resistance means for providing a resistance force which may be varied coupled to the operating means, wherein the operating means comprises a handle and is movable by action of a user along the path defined by the track against the resistance force provided by the resistance means, said operating means further comprising a first bearing member connected to said handle, said track having an open end and comprising a second bearing member, said second bearing member comprising an elongate channel, the first bearing member comprising a runner coupled for movement relative to said second bearing member and coupling means formed as a flexible elongate member and comprising first and second portions for coupling said resistance means to the handle, said first portion of said coupling means being retained within said channel, said first portion of said coupling means situated between said handle and said open end of said channel and said second portion of said coupling means extending out of said channel and engaging said resistance means, said resistance means comprises at least one weight arranged to be raised above the ground when said handle is moved along the channel in a first direction, a frame having a vertical central portion and arcuate arms extending from said central portion, said frame connected to said channel and wherein the position of connection is adjustable to vary the elevation and/or inclination angles of the channel with respect to the frame.

14. A resistance training device comprising a track defining a predetermined at least a partially non-linear path operating means coupled to the track, and resistance means for providing a resistance force coupled to the operating means, wherein the operating means is movable by action of a user along the path defined by the track against the resistance force provided by the resistance means, said path having a beginning and an end, said track comprising an elongate channel having a closed upper portion, said operating means having first and second positions along the path defined by the track, said first and second positions being at the beginning and the end of said path, respectively, and coupling means for coupling said resistance means to the operating means, said coupling means comprising a flexible elongate member having at least a first portion being within said channel, the portion of said cable disposed in said channel between said first and second positions constituting a major portion of said cable.

15. A resistance training device comprising a track defining a predetermined at least a partially non-linear path which defines a plane, operating means coupled to the track and positionable along said path, and resistance means for providing a resistance force coupled to the operating means, wherein the operating means is movable by action of a user along the path defined by the track against the resistance force provided by the resistance means, said track comprising an elongate channel having a closed upper portion, and coupling means for coupling said resistance means to the operating means, said coupling means comprising a flexible elongate manner having at least a first portion being within said channel, said first portion of said flexible elongate member being totally within said plane regardless of the position of said operating means along said predetermined path.

* * * * *